US007510814B2

(12) United States Patent
Liu et al.

(10) Patent No.: US 7,510,814 B2
(45) Date of Patent: Mar. 31, 2009

(54) TONER AND METHODS OF PRODUCING SAME

(75) Inventors: Ming-Huei Liu, Jhubei (TW); Li-Chi Su, Houlong Township, Miaoli County (TW); Cheng-Pang Ting, Jhubei (TW); Chien-Chung Bi, Taichung (TW)

(73) Assignee: Sinonar Corporation, Hsinchu (TW)

( * ) Notice: Subject to any disclaimer, the term of this patent is extended or adjusted under 35 U.S.C. 154(b) by 323 days.

(21) Appl. No.: 11/443,891

(22) Filed: May 31, 2006

(65) Prior Publication Data

US 2007/0254227 A1 Nov. 1, 2007

(30) Foreign Application Priority Data

Apr. 28, 2006 (TW) ..... 95115238 A

(51) Int. Cl.
*G03G 9/08* (2006.01)

(52) U.S. Cl. ..... 430/137.14; 430/105

(58) Field of Classification Search ..... 430/105, 430/137.14

See application file for complete search history.

(56) References Cited

U.S. PATENT DOCUMENTS

| | | | | |
|---|---|---|---|---|
| 4,123,403 | A | 10/1978 | Warner et al. | |
| 5,344,738 | A * | 9/1994 | Kmiecik-Lawrynowicz et al. | 430/137.14 |
| 5,567,558 | A | 10/1996 | Yang et al. | |
| 5,691,095 | A | 11/1997 | Shinzo et al. | |
| 5,728,499 | A | 3/1998 | Hung et al. | |
| 5,928,831 | A | 7/1999 | Nakamura | |
| 6,001,528 | A | 12/1999 | Nagai et al. | |
| 6,068,958 | A | 5/2000 | Yang et al. | |
| 6,090,511 | A | 7/2000 | Yang et al. | |
| 6,171,743 | B1 | 1/2001 | Nakamura | |
| 2003/0175609 | A1 * | 9/2003 | Combes et al. | 430/108.22 |
| 2006/0063089 | A1 * | 3/2006 | Tanaka et al. | 430/110.3 |

FOREIGN PATENT DOCUMENTS

| | | |
|---|---|---|
| JP | 61-91666 | 2/1988 |
| JP | 63-25664 | 2/1988 |
| JP | 04-303849 | 10/1992 |

* cited by examiner

*Primary Examiner*—John L Goodrow
(74) *Attorney, Agent, or Firm*—Morris Manning Martin LLP; Tim TIngkang Xia, Esq.

(57) ABSTRACT

A toner and a method of producing same. In one embodiment, the method includes the steps of forming an organic phase containing a resin, an organic solvent, a colorant, a charge control agent, and a phase change stabilizer, wherein the organic solvent is characterized in that the resin is soluble in the organic solvent and the organic solvent and water are at least partially miscible; forming an aqueous phase containing water, an anticoagulant, an accelerant, and optionally an auxiliary agent; mixing the aqueous phase with the organic phase to form a solution having resin colloidal microparticles formed and stably dispersed therein, whereby the resin colloidal microparticles aggregate, coalesce and solidify out into resin particles in the solution, meanwhile the organic solvent is removed from the resin particles by the aqueous phase; and curing the resin particles to obtain toner particles having shapes, diameters, and diameter distribution that are controllable.

25 Claims, 1 Drawing Sheet

TONER AND METHODS OF PRODUCING SAME

CROSS-REFERENCE TO RELATED REFERENCES

Some references, which may include patents, patent applications and various publications, are cited and discussed in the description of this invention. The citation and/or discussion of such references is provided merely to clarify the description of the present invention and is not an admission that any such reference is "prior art" to the invention described herein. All references cited and discussed in this specification are incorporated herein by reference in their entireties and to the same extent as if each reference was individually incorporated by reference.

FIELD OF THE INVENTION

The present invention relates to a toner and methods of producing same. More particularly, it relates to a method of producing a toner whose particle shapes, diameters, and diameter distribution are controllable and a toner produced accordingly.

BACKGROUND OF THE INVENTION

In order to enhance printing resolution and output efficacy, most xerographic devices use a toner composition having sphere or sphere-like particles with a high degree of luster, small particle diameters, and a narrow distribution of the particle diameters to produce their outputs. The smaller the particle diameters and the narrower the particle diameter distribution of the toner particles, the better the printing resolution and uniformity of the outputs are. Additionally, an excessive amount of a luster releasing agent is usually added in the toner composition to improve the printing glossiness. Sphere or sphere-like toner particles have better particle transferring efficiency and flowability. The output efficacy of a xerographic device depends upon the hot-fixing ability of the toner particles. Therefore, a preferable resin used to produce a toner composition will be the resin having a strong elasticity and a low melting temperature, such as polyester.

Generally, toner production processes can be classified as a grinding method and a non-grinding method. Conventional toner particles are manufactured by the grinding method, where the resin used must be brittle. Resins with lower molecular weights are usually chosen for this purpose. However, for such resins, when grinding, flakes and dust powders are formed, which may contaminate the carrier of static developer and make the carrier functionless. For the low molecular weight resins, the weakness in its mechanical strength and melting elasticity may result in toner particles sticking on surfaces of printer parts, such as developer roller, wipe blade, organic photoconductor (OPC) drum or fuser roller, etc, thereby causing printing defects, for example, vertical scratches and/or hot-offset. The thermal properties of the low molecular weight resins, such as glass transferring temperature, are difficult to control. Besides, the toner particles manufactured according to the conventional grinding method vary greatly in size, which leads to the reduction of the production rate of toner particles, and therefore, increase of the production cost. When in use, the irregularity of sizes of the toner particles reduces the printing quality of printing image. Because the size of toner particles is hard to control during grinding, a lot of tiny toner particles are produced. The tiny toner particles can cumulate inside the developer of printing devices, which may reduce the lifetime of the developer.

To overcome the above mentioned disadvantages, a non-grinding method has been introduced for producing toner particles. Toner particles according to the non-grinding method are uniform in shape and size, and sphere or sphere-like. Non-brittleness resins can also be used for toner production by the non-grinding method. Additionally, the non-grinding method can be used for the thermal sensitive toner additives. At present, a non-grinding, wet aggregation-coalescence method is frequently adapted for toner production. Based on the way of aggregation-coalescence of particles, the method is categorized into a suspension method and an emulsion-aggregation method.

The so-called suspension method includes two methods. One is a suspension polymerization method. The suspension polymerization method comprises mixing vinyl monomer, a pigment, and additives to form an oil phase; suspending the oil phase into an aqueous phase containing a dispersing agent by a homogenizer; and adding a radical polymerization initiator to polymerize the vinyl monomer to obtain spherical polymer particles. Note that, according to the method, resins are limited to vinyl polymer resulting from radical polymerization. The polymerizing process takes longer and may be disturbed by additives. Additionally, monomer residues in polymerization are not easily removed.

The other suspension method is a resin dispersion method. The method includes the processes of dissolving resin in a solvent that is immiscible with water; suspending the resin solution in an aqueous phase that contains dispersing agent by a homogenizer; allowing the resin particles to aggregate and coalesce to a desired size; and removing the solvent and obtaining resin particles. The method is suitable for any types of resins. However, a high-speed and high shearing homogenizer is necessary for implementing the method, which consumes a lot of energy. Additionally, resin particles according to the method may not be uniform in size since the resin colloidal particle are dispersed a mechanical force.

For the emulsion-aggregation method, a resin emulsion is formed, and aggregation and coalescence occur in the resin emulsion to form the desired size of resin particles. Based on the process of forming the resin emulsion, the emulsion-aggregation method can be classified into three categories: The first category is an emulsion polymerization method, which includes the steps of mixing an oil phase having a vinyl monomer with an aqueous phase having an emulsion agent, dispersing it with an emulsion homogenizer, and adding an initiator to trigger polymerization to form a resin emulsion. Similar to the suspension polymerization method, the method is suitable for limited types of resins; and there are also drawbacks of a long polymerization time and monomer residues.

The second category is direct emulsification, which includes dissolving a resin in a solvent to form an oil phase, mixing the oil phase with an aqueous solution having an emulsion agent, then, directly dispersing it with an emulsion homogenizer to form a resin emulsion. The method is suitable for any types of resins. Similar to the resin dispersion method, the process has the high energy consumption and the need of removal of solvents.

The third category is indirect emulsification, which comprises the steps of dissolving resin in a solvent to form an oil phase, adding an aqueous solution containing a emulsion dispersing agent to the oil phase, triggering phase changes by altering the volume ratio of the oil and aqueous phases so as to obtain a resin emulsion of high stability and uniform particle distribution. The method has been reported, for examples, in U.S. Pat. Nos. 5,928,831, 6,001,528, and 6,171,743, and Japan Pat. Nos. 61-91666, 63-25664 and 04-303849. According to the method, there is no limit to resins to be used and no need of an energy consumed homogenizer. However, for highly viscous resins, such as resins of high molecular weights and high solid content, phase changes of the emulsion may be interrupted, thereby causing unstable suspension solution with large resin particles to be formed or a phase separation. Accordingly, diameters and a diameter distribution of resin particles to be produced are uncontrollable. This is because, during phase changes, the viscosity ratio of the solution will increase suddenly, which makes the viscosity ratio of the resin emulsion too high. For an operation of at a low rotating speed, a highly viscous resin can not be effectively cut into emulsion microparticles. Therefore, a suspension solution with large and non-uniformly sized particles can be formed, and the resin may even precipitate to form chunk pieces of the resin in certain cases. As a matter of course, the indirect emulsification method is only suitable for resin solutions having low viscosity ratio, such as low molecular weight or low solid content resin solutions. As discussed above, the use of a low molecular weight resin to producing toner particles has disadvantages.

U.S. Pat. No. 5,691,095 discloses an improvement of the method by using self-emulsifiable resin, which is suitable for a high molecular weight and solid content resin solution. According to the improved method, a dispersibly and stably hydrophilic base is introduced into a resin to make the resin self-emulsifiable, dispersible and stable. However, the resin is specially made, this may increase the production cost. Additionally, the hydrophilic base in the resin may adsorb to water in the air, which may result in negative effects on the environment and the toner electrostatic property.

As discussed above, the third category of the indirect emulsification method requires no limitation in material selection and manufacturing facilities. However, there are several questions the method is unable to answer: (1). for an operation at a low rotating speed, how to form uniform, stable, and dispersed emulsion particles from highly viscous resins with high molecular weights and high solid content, so as to increase productivity; (2). how to quickly remove the solvent from liquidized resin particles, and meanwhile to remain the dispersion stability of emulsion particles unchanged, so as to reduce production time; (3). how to precisely control shapes, diameters, and a diameter-distribution of toner particles, so as to improve the printing quality.

The printing quality of laser printers is greatly affected by the shapes, diameters, and diameter-distribution of toner particles. This is especially true to grayscale and full color printings that require high quality of image printing. Uniformly sized toner particles can produce smooth images and good color concentration while consuming less toner. Thin and smooth layer of toner make better transparency properties of images and the texture of images looks similar to lithograph. Moreover, because of the thin layer of toner on images, the efficacy of heat fixing for a printer is improved, leading to reducing energy consumption and increasing print speed.

It is known that the shapes of toner particles play an important role in tribocharging, powder flowability, cleanability, accumulation density, uniformity of the toner particles. The rougher the surface (e.g., conventional toners) of a toner particle is, the greater the surface friction is, and the better tribocharging and cleanability properties it bears. However, the rough surface of toner particle causes poor powder flowability, accumulation density, and uniformity. On the other hand, the more uniform shape and narrow diameter distribution toner particles have, the more uniform tribocharging, and the higher toner transfer efficiency, and the better accumulation density and uniformity the printing images show. However, the toner particles have poor tribocharging and cleanability properties. Therefore, a key process in toner productions is to manufacture toner particles having their shapes controllable.

For toner particles having different diameters, different particles obtain different tribocharging during operation of a toner cartridge. The difference makes small toner particles bearing higher electrostatic charges, which result in poor printing images and lack of toner powder transferring when printing. Moreover, non-uniform distributed electric charges on toner particles may cause printing offset, backgrounding and smear edges.

Briefly, in the non-grinding methods, resins to be used are limited, for example, it may not be efficient for highly viscous resins of high molecular weights and high solid content. Additionally, toner production processes are highly energy consumed. For toner particles manufactured according to the conventional methods, their shapes, diameters, diameter distribution are not controllable.

Therefore, a heretofore unaddressed need exists in the art to address the aforementioned deficiencies and inadequacies.

SUMMARY OF THE INVENTION

In one aspect, the present invention relates to a method of producing a toner useable in an image forming apparatus such as a xerographic device, where the xerographic device can be a laser printer, a copier, an all-in-one office machine, a fax machine, and an electrostatic xerographic printer. In one embodiment, the method includes the steps of forming an organic phase containing a resin, an organic solvent, a colorant, a charge control agent, and a phase change stabilizer, wherein the organic solvent is characterized in that the resin is soluble in the organic solvent and the organic solvent and water are at least partially miscible; forming an aqueous phase containing water, an anticoagulant, an accelerant, and optionally an auxiliary agent; mixing the aqueous phase with the organic phase thoroughly to form a solution having resin colloidal microparticles formed and stably dispersed therein, whereby the resin colloidal microparticles aggregate, coalesce and solidify out into resin particles in the solution, wherein the solvent is removed from the resin particles by the aqueous phase; and curing the resin particles to obtain toner particles having shapes, diameters, and diameter distribution that are controllable.

The mixing step comprises the steps of stirring the organic phase evenly; adding the aqueous phase into the stirred organic phase to form a mixture of the aqueous phase and the organic phase; and stirring the mixture. The curing step may comprise filtering, washing, and drying the resin particles.

In one embodiment, the resin is insoluble in water, and comprises a polyamide, polyester, styrene-acrylate copolymer, polystyrene, acrylic resin, epoxy resin, copolyamide, polyolefin, polycarbonate, polyacrylamide, ethylene-vinyl acetate copolymer, polyvinyl acetate, polyvinyl butyral, or combinations thereof.

The phase change stabilizer comprises a releasing agent, a lubricant, and an amphiphilic material. In one embodiment, the releasing agent has a paraffin, fatty alcohol, fatty acid, fatty acid salt, polyethylene (PE) wax, polypropylene (PP) wax, polyester wax, animal wax, plant wax, synthesized wax, or combinations thereof. The lubricant comprises a fatty acid salt, resin microparticles, inorganic microparticles, or combinations thereof. The amphiphilic material comprises a fatty alcohol, fatty acid, or combinations thereof.

In one embodiment, the phase change stabilizer is characterized in that when dispersed in the organic phase, the phase change stabilizer is in a gelation state or in a form of microparticles having an average diameter of about 0.1-1 μm.

In one embodiment, the step of forming the organic phase comprises the step of dispersing the phase change stabilizer in the organic phase, wherein the step of dispersing the phase change stabilizer comprises the steps of dissolving the phase change stabilizer in the organic phase; reducing the temperature of the organic phase or adding a nonsolvent into the organic phase to induce separations of the phase change stabilizer to form a gelation state or a form of microparticles having an average diameter of 0.1-1 μm; and high-speed stirring the organic phase to directly disperse microparticles of the phase change stabilizer into the organic phase, wherein the microparticles have an average diameter of 0.1-1 μm.

In one embodiment, the organic solvent includes a methanol, ethanol, n-propanol, iso-propanol, n-butanol, iso-butanol, tert-butanol, ethyl acetate, methyl acetate, ethyl formate, propylene glycol monomethyl ether acetate, ethylene glycol monoethyl ether acetate, ethylene glycol monomethyl ether acetate, acetone, methyl ethenyl ketone, methyl isobutyl ketone, methyl isopropyl ketone, cyclohexanone, ethylene glycol monobutyl ether, propylene glycol monomethyl ether, ethylene glycol monoethyl ether, tetrahydrofuran, dichloromethane, dichloroethane, chloroform, or combinations thereof.

The anticoagulant includes a polyvinyl alcohol, polyvinylpyrrolidone, methyl cellulose, ethyl cellulose, carboxymethyl cellulose (CMC), CMC salt including CMC-Na, hydroxyethyl cellulose, hydroxypropyl cellulose, hydroxyethyl methyl cellulose, hydroxypropyl ethyl cellulose, polyacrylic acid salt, polyacrylic amide, gelatin, acacia gum, starch, polyoxypropylene-polyoxyethylene copolymer, and combinations thereof.

The accelerant includes an alkylsulfate, alkylsulfonate, alkylnaphthalene sulfonate, alkylpolyoxyethylene ether, alkylpolyphenol ethoxylate, polyoxyethylene sorbitan fatty acid ester (Tween), sorbitan fatty acid ester (Span), or combinations thereof.

The auxiliary agent includes one of a monovalent salt, divalent salt, trivalent salt, and inorganic acid or alkali, wherein the monovalent salt includes sodium chloride, the divalent salt includes sodium sulfate, the trivalent salt includes aluminum sulfate, and the inorganic acid or alkali includes sodium hydroxide or nitric acid.

In one embodiment, the shapes, diameters, and diameter distribution of the toner particles can be controlled by adjusting at least one of a concentration of the phase change stabilizer in the organic phase; a solubility of the organic phase in water; a solid content of the organic phase; a viscosity ratio of the organic phase to the aqueous phase; and a stirring speed for aggregation and coalescence.

The diameters and the diameter distribution of the toner particles are reversely proportional to the concentration of the phase change stabilizer, preferably, the concentration of the phase change stabilizer being about 0.1-20 wt%.

The solubility of the organic phase in water is preferably greater than 1 wt%.

The diameters and the diameter distribution of the toner particles are proportional to the solid content of the organic phase, preferably, the solid content of the organic phase being about 30-80 wt%.

The diameters and the diameter distribution of the toner particles are reversely proportional to the viscosity ratio of the organic phase to the aqueous phase, preferably, the viscosity ratio of the organic phase to the aqueous phase being about 0.05-20.

The diameters and the diameter distribution of the toner particles are reversely proportional to the stirring speed, preferably, the stirring speed being about 800-3000 rpm.

In another aspect, the present invention relates to a toner produced according to the above method.

These and other aspects of the present invention will become apparent from the following description of the preferred embodiment taken in conjunction with the following drawings, although variations and modifications therein may be affected without departing from the spirit and scope of the novel concepts of the disclosure.

DETAILED DESCRIPTION OF THE INVENTION

Figure 1:
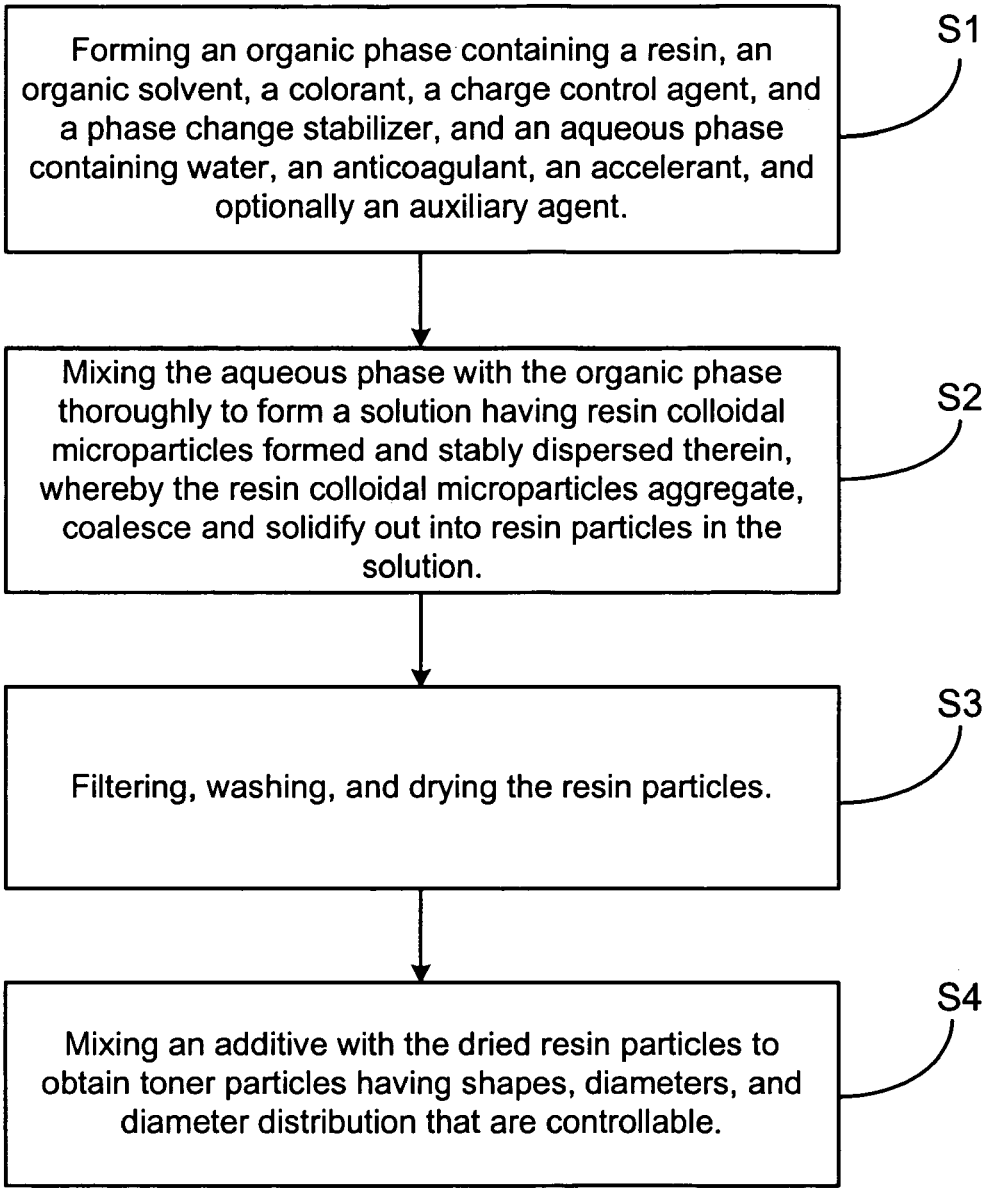
FIG. 1 shows a flowchart of a process of producing toner according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Additionally, some terms used in this specification are more specifically defined below. Moreover, certain theories are proposed and disclosed herein; however, in no way they, whether they are right or wrong, should limit the scope of the invention. Furthermore, titles or subtitles may be used in the specification for the convenience of a reader, which shall have no influence on the scope of the present invention.

As used herein, the term "miscible" and mutually soluble" are synonyms in the specification and refers to the property of various liquids that allows them to be mixed together. If two liquids are mutually soluble in all proportions, they are said to be completely miscible. Two liquids that dissolve in each other to some extent but not completely are referred to as partially miscible. Two liquids that do not appreciably dissolve in each other are said to be immiscible.

The term "solubility", as used herein, refers to the amount of a substance that can be dissolved in a given amount of solvent.

The term "solid content", as used herein, refers to a ratio of the amount of a substance in a solid state to the amount of a solution that contains the substance.

The description will be made as to the embodiments of the present invention in conjunction with the accompanying drawing. In accordance with the purposes of this invention, as embodied and broadly described herein, this invention, in one aspect, relates to a non-grinding method of producing a toner composition used in xerographic devices. The method improves the shortcomings of which conventional toner production process are not effective for highly viscous resins of a high molecular weight and a high solid content. The method enables one to quickly remove the solvent from liquidized resin particles, and meanwhile to remain the dispersion stability of resin particles unchanged.

Another aspect of the present invention provides a toner composition produced according to the invented method. The toner composition is used in a xerographic device, such as a laser printer, a copier, a fax machine, and all-in-one office machine, or the like.

The present invention, in yet another aspect, relates to a method of controlling shapes, diameters, and size distributions of toner particles in the manufacturing process. The method comprises controlling the concentration of a phase change stabilizer in an organic phase; controlling the compatibility of an organic phase and an aqueous phase; adjusting the anticoagulant's dispersing and stabilizing properties (concentration and types); altering the solidity in an organic phase, or changing a speed of stirring.

Referring to FIG. 1, a method of producing a toner composition according to one embodiment of the present invention is shown. The method includes the following steps: At step S1, an organic phase and an aqueous phase are formed. The organic phase contains a resin, an organic solvent, a colorant, a charge control agent (CCA), and a phase change stabilizer, where the organic solvent is adapted such that the resin is soluble in the organic solvent and the organic solvent and water are at least partially miscible. The aqueous phase contains water, an anticoagulant, and an accelerant. Optionally, the aqueous phase may contain an auxiliary agent.

At step S2, the aqueous phase is mixed with the organic phase thoroughly to form a water solution having resin colloidal microparticles are formed and stably dispersed therein. The mixing step is performed by stirring the organic phase evenly; adding the aqueous phase into the organic phase to form the water solution; and stirring the water solution. The stirring speed can be uniform speed or variable. During the mixing process, the resin colloidal microparticles aggregate and coalesce and then solidify out into resin particles in the solution, where the resin particles are separable from the water solution.

At step S3, the resin particles in the solution are filtered and washed, and the resultant resin particles are then dried. At step S4, an additive is mixed with the dried resin particles as to obtain toner particles having shapes, diameters, and diameter distribution that are controllable.

The colorant used in the present invention has a high degree of color saturation, and is durable and resistant to environmental effects, compatible with the resin, and easily dispersed. In one embodiment, the colorant includes pigments and dyes. The pigments include black pigments (carbon black, ferric oxide, etc.), blue pigments (C.I. Pigment Blue 7, 62, 66, 15: 1, 15:3, 152, etc.), red pigments (C.I. Pigment Red 2, 6, 48:1, 57:1, 81, 122, 146, 184, 185, 238, 269, etc.), and yellow pigments (C.I. Pigment Yellow 12, 17, 74, 83, 97, 136, 151, 154, 180, 185, etc.), and the like. The dyes are insoluble in a continuous phase of a water solution. In one embodiment, the dyes include dispersing dyes and oil-soluble dyes, or the like. According to the present invention, the concentration of the colorant in the toner composition is about 1-15% by weight, preferably, about 2-10% by weight. The diameter of the insoluble colorant is in the range of about 0.01-1 μm, preferably, about 0.05-0.5 μm.

The phase change stabilizer is adapted to be compatible with other toner ingredients. When the phase change stabilizer is dispersed in the organic phase, it is in a gelation state or in a form of microparticles having the average particle size of about 0.1-1 μm. The phase change stabilizer in one embodiment includes a releasing agent, a lubricant, and an amphiphilic material. The phase change stabilizer may further include an emulsification-promoted releasing agent, or the like. Accordingly, the phase change stabilizer is capable of performing different functions simultaneously of these materials, such as the releasing agent, the lubricant, and the amphiphilic material. In one embodiment, the releasing agent comprises paraffin, fatty alcohol, fatty acid, fatty acid salt, polyethylene (PE) wax, polypropylene (PP) wax, polyester wax, animal wax, plant wax, synthesized wax, or combinations thereof. The lubricant comprises a fatty acid salt, resin microparticles, inorganic microparticles, or combinations thereof. The amphiphilic material comprises a fatty alcohol, fatty acid, or combinations thereof.

A process of dispersing the phase change stabilizer into the organic phase includes the steps of dissolving the phase change stabilizer in the organic phase; reducing the temperature of the organic phase or adding a nonsolvent into the organic phase to induce phase separations of the phase change stabilizer to form a gelation state or a form of microparticles having an average diameter of 0.1-1 μm; and high-speed stirring the organic phase to directly disperse microparticles of the phase change stabilizer into the organic phase, wherein the microparticles have an average diameter of 0.1-1 μm.

In one embodiment, the concentration of the phase change stabilizer in the toner composition is in the range of about 0.1-30% by weight, preferably about 0.1-20% by weight.

The charge control agent according to one embodiment of the present invention includes a predetermined polarity of charges so as to make the tribocharging in the surface of toner particles maintained within a proper range. The charge control agent comprises a quaternary ammonium salt, salicylic acid metal-complex, azo metal-complex, aromatic carboxylic metal-complex, and the derivatives of these compounds. In one embodiment, the charge control agent in the toner composition is in the range of about 0.1-20% by weight, preferably, about 0.1-10% by weight.

According to the present invention, the resin is adapted to have at least a good compatibility with other toner additives, ability of tribocharging, an appropriate fixing property, and a strongly mechanical strength. The resin is insoluble in water. In one embodiment, the resins include polyamide, copolyamide, polyester, acrylic resin, polystyrene, epoxy resin, styrene-acrylate copolymer, polyolefin, polycarbonate, polyacrylamide, ethylene-vinyl acetate copolymer, polyurethane, polyvinyl acetate, polyvinyl butyral, copolymers, or mixtures of them. The resin has a weight-average molecular weight (Mw) in the range of about 10,000-500,000, and a number-average molecular weight (Mn) in the range of about 3,000-50,000. The concentration of the resin in the toner composition is in the range of about 50-95% by weight, preferably, about 70-90% by weight.

The organic solvent is adapted such that the resin is soluble in the organic solvent and the organic solvent and water are at least partially miscible. Additionally, the organic solvent is compatible with toner additives, and ease of recycle and separation. In one embodiment, the organic solvent is selected from a group of consisting of methanol, ethanol, n-propanol, iso-propanol, n-butanol, iso-butanol, tert-butanol, glycerol, ethylene glycol; ethyl acetate (EAc), methyl acetate, ethyl formate, propylene glycol monomethyl ether acetate (PMA), ethylene glycol monoethyl ether acetate, ethylene glycol monomethyl ether acetate; acetone, methyl ethenyl ketone (MEK), methyl isobutyl ketone, methyl isopropyl ketone, cyclohexanone (CYC); tetrahydrofuran (THF), dioxane, ethylene glycol monobutyl ether, propylene glycol monomethyl ether, ethylene glycol monoethyl ether; benzene, xylene; dichloromethane, dichloroethane, chloroform, and any mixtures thereof.

The more compatible to the resin and additives the organic solvent is, the better it is for producing a toner composition. In one embodiment, the solubility of the organic solvent in water is greater than about 0.1% by weight, preferably, greater than about 1% by weight. The organic solvent that is miscible with water can be used to control the speed of solidification of resin colloidal particles. In one embodiment, the solid content of the resin in the organic solvent is in the range of about 20-90% by weight, preferably, about 30-80% by weight. Accordingly, the viscosity of the resins solution is in the range of about 10-20,000 cp, preferably, about 100-10,000 cp.

The anticoagulant is adapted for stabilizing, dispersing, and separating out resin particles, inhibiting excessive aggregation of resin colloidal microparticles as to prevent from formation of resin chunks. Additionally, the anticoagulant is miscible with water or capable of forming uniformly dispersed water solution. In one embodiment, the anticoagulant is selected from a group of consisting of polyvinyl alcohol, polyvinylpyrrolidone, methyl cellulose, ethyl cellulose, carboxymethyl cellulose (CMC), CMC salt including CMC-Na, hydroxyethyl cellulose, hydroxypropyl cellulose, hydroxyethyl methyl cellulose, hydroxypropyl ethyl cellulose, polyacrylic acid salt, polyacrylic amide, gelatin, acacia gum, starch, polyoxypropylene-polyoxyethylene copolymer, and any combinations thereof. In one embodiment, the concentration of the anticoagulant in the aqueous phase is in the range of about 0.1-30% by weight, preferably, about 0.1-20% by weight. The viscosity of the aqueous phase is about 1-30,000 cp, preferably, about 10-15,000 cp.

According the present invention, the accelerant is capable of reducing the tension of the interface between the organic phase and the aqueous phase, and promoting formation of a stable colloid phase. The accelerant in one embodiment includes solvents having a low surface tension and interface activators. The solvents having a low surface tension include solvents that are completely or partially miscible with water, such as alcohol, ketone, amine, ester, and the like. The interface activators include ion interface activators, such as alkylsulfate, alkylsulfonate, alkylnaphthalene sulfonate, fatty acid salt, alkylphosphate, alkylaminoate, and the like. The interface activators also include non-ion interface activators such as alkylpolyoxyethylene ether, alkylpolyphenol ethoxylate, alkylolamide, polyoxyethylene sorbitan fatty acid ester (Tween), sorbitan fatty acid ester (Span), and the like. The selection of the interface activators of the accelerant depends upon systems. For example, for a system of water dispersing in oil, the interface activators is selected such that the accelerant has a value of the hydrophile-lipophile balance (HLB) between 3 and 6; while for the system of oil dispersing in water, the interface activators is selected such that the accelerant has a value of the HLB between 8 and 15. In one embodiment, the concentration of the accelerant in the aqueous phase is in the range of about 0.1-20% by weight, preferably, about 0.1-10% by weight.

The auxiliary agent according to the present invention is adapted for promoting aggregation and coalescence of microparticles. The auxiliary agent includes an inorganic salt, organic salt, ion resin, inorganic acid and alkali, or the like. In one embodiment, the inorganic salt has sodium chloride, sodium carbonate, sodium sulfate, sodium phosphate, sodium nitrate, aluminum sulfate, or the like. The organic salt includes sodium acetate and ammonium acetate. The ion resin includes sodium polystyrene sulfonate, sodium polyacrylate and polyacryl. amide, etc. The inorganic acid and alkali includes sulfuric acid and sodium hydroxide, etc. In one embodiment, the concentration of the auxiliary agent in the aqueous phase is in the range of about 0.1-20% by weight, preferably, about 0.1-10% by weight.

The use of an auxiliary agent is optional according to the present invention. For example, for a system of which resin microparticles can easily and quickly solidify, there is a need to add an auxiliary agent into the system to speed up phase change, aggregation and coalescence of the resin microparticles so as to ensure that the aggregation and coalescence of the resin microparticles occur before they solidify.

The present invention, among other things, discloses a non-grinding method of producing a toner composition, which has at least three unique features: first, the method enables one to form a uniformly and stably dispersed emulsion from a liquidized resin of a high molecular weight and high solid content, at a low rotating speed of operation. This may lead to an increase of the efficiency of production of a toner composition. Second, the method enables one to quickly remove the solvent from liquidized resin particles and meanwhile to remain the dispersion stability of resin particles unchanged, which may reduce the time of production of a toner composition. Third, according to the present invention, the shapes, diameters, and diameter distribution of resin particles of a toner composition are precisely controllable by simple production processes, thereby improving the quality of printing when the toner composition is used.

To implement the first unique feature of the present invention, at a low rotating speed of operation, a highly viscous anticoagulant is applied to in the aqueous phase. Additionally, an amount of an accelerant is also added into the aqueous phase for speeding up the formation of an emulsion in a mixture of the aqueous phase with the organic phase.

Briefly, during the formation of the emulsion, the interface of a dispersion phase is curved and deformed, which causes the membrane of dispersion solution getting thinner and broken so as to form emulsion particles. Therefore, to form such emulsion solution particles, there is a need to overcome the Yang-Laplace pressure gradient due to curving and deforming of the interface between two phases, and a viscous force when the membrane of an organic phase becomes thinner, during the change of a solution phase. The pressure gradient on the interface and the viscous force of the organic phase can be overcome by the interface tension and viscous force of an aqueous phase. In terms of the pressure gradient of interface, an accelerant can be added to reduce the interface tension. However, for a highly viscous liquidized resin of a high molecular weight and high solid content, the viscous force of the organic phase is very high, which causes the membrane of the organic phase not to break easily. Accordingly, it is difficult for the highly viscous organic phase to complete phase changes of emulsion. Therefore, for a system of a highly viscous dispersion phase, a high shearing homogenizer should be used to improve emulsification of the organic phase.

According to the present invention, at a low rotating speed of operation, a highly viscous aqueous phase and a phase change stabilizer are utilized to prevent from generating an unstable phase change in such a highly viscous dispersion system, thereby avoiding the use of an energy-consumed high-speed homogenizer. A stable and continuous aqueous phase can be obtained easily from a highly viscous aqueous phase. In addition, the application of an emulsifier and a phase change stabilizer improves stable phase changes so as to form a emulsion. Moreover, the highly viscous aqueous phase possesses a higher viscous-shear force, which facilitates the interface of dispersion phase becoming curved and deformed and makes the membrane of the organic phase effectively thinner, thereby fulfilling the phase change to form the emulsion. Therefore, the viscosity ratio of the organic phase to the aqueous phase, regarding system whether can complete the emulsion phase change smoothly, has the decisive relations. The viscosity ratio is in the range of about 0.01~30, preferably, about 0.05~20.

According to the present invention, the second feature is implemented by using an organic solvent in the organic phase that is at least partially miscible with water. As discussed above, the highly viscous continuing phase is capable of reducing diffusion of the organic solvent into the aqueous phase, whereby during a phase change, a quick separation of the solvent does not cause a separation of a solidification phase of the system. Therefore, the aggregation and coalescence of microparticles occur even after a phase change of emulsion, thereby reducing the production time of a toner composition and remaining the dispersion stability of emulsion unchanged.

The shape, diameters, and size distribution of toner particles of a toner composition according to the present invention is controlled by the concentration of the phase change stabilizer in the organic phase, the solubility of the organic phase in water, the solid content of the organic phase, changing the viscosity ratio of the organic phase to the aqueous phase, or a stirring speed for aggregation and coalescence of microparticles.

The Concentration of the Phase Change Stabilizer: Based on a theoretical analysis of aggregation and coalescence for colloidal resins, to obtain particles having a narrow distribution of particle diameters, two processes, formation of the particles and growth of the particles should be separated. Primary resin particles with a uniform diameter are helpful to control the diameter and the diameter distribution of the ultimate resin particles. Accordingly, a phase change stabilizer added into an organic phase can improve the stability of emulsion phase changes, thereby resulting in an emulsion with a uniform diameter of emulsion particles, which improves merging and growing of uniform emulsion particles. Furthermore, an aqueous phase is formed with a highly viscous anticoagulant for separating formation of the particles and growth of the particles. According to the present invention, the diameters and the diameter distribution of the toner particles are reversely proportional to the concentration of the phase change stabilizer. A proper amount of the phase change stabilizer can reduce the diameter of the particles and narrow the diameter distribution of the particles. However, an excessive amount of the phase change stabilizer increases the viscosity of the resin solution, which may diminish the effect of the phase change stabilizer. In one embodiment, the concentration of the phase change stabilizer in the organic phase is in the range of about 0.1-20 wt%.

The Solubility of the Organic Phase in Water: Adjusting the solubility of the organic phase in water modifies the compatibility of the organic phase to the aqueous phase, resin, and toner additives and changes dispersion stability of resin emulsion. If the compatibility of the organic phase to resins and toner additives is poor, or the solubility of the organic solvent in water is too high, the solidification of resins occurs fast. A quick solidification of resins may cause resins and additives to separate in a different pace during a phase change, resulting uncolored or incomplete covered resin particles and forming chunks of resins when aggregating and coalescing. In contrast, if the solubility of the organic solvent in water is too poor, it may not effectively dissolve in the aqueous phase so that the solidification of resin particles does not occur, thereby resulting in re-coagulating of particles to form large sized particles or chunks of resins, even agglomerating of particles and separating out.

According to the present invention, a proper solubility of organic solvent can be applied to control a primary particle separation and the solidification rate, thereby adjusting particle shapes, reducing particle diameters and narrowing the distribution of particle diameters. The compatibility of the organic solvents is obtained by mixing of different polarities with different solubility of the solvent. The process of forming particle aggregation and coalescence by using of organic solvents to modify the compatibility of the organic solvent so as to adjust the shapes, diameters, and diameter distribution of toner particles is easier than the process by changing molecular weight and polarity of resins. In one embodiment, the solubility of the organic phase in water is preferably greater than 1 wt%.

The Solid content of the Organic Phase: Adjusting the solid content in the organic phase can change the stability of phase change of emulsion and therefore affect diameters of toner particles. According to the present invention, the diameters and the diameter distribution of the toner particles are proportional to the solid content of the organic phase. A high solid content of the organic phase means a high viscosity in the organic phase, which may lead to chunks of resins and large sized particles formed and a wide distribution of particle diameters. For a low solid content of the organic phase, a stable emulsion with particles of a uniform diameter is formed, thereby forming resin particles having small diameters and a narrow diameter distribution. However, lowering the solid content may reduce the production rate of the toner composition. In one embodiment, the solid content of the organic phase is in the range of about 30-80 wt%.

Anticoagulant, Accelerant, and Auxiliary Agent: The use of a highly viscous aqueous phase formed with an anticoagulant not only improves stable phase change for a resin of a high molecular weight and high solid content, but also stabilize the dispersion of emulsion particles after the phase change, so as to minimize and uniform emulsion particles at a low rotating speed of operation. Meanwhile, it may reduce the separation rate of an organic solvent and control shapes, diameters, and diameter distribution of resin particles, which are formed from emulsion aggregation and coalescence. An emulsion accelerant is adapted for lowering a surface tension and reducing energy required for emulsion formation. The lower surface tension, the more stable the emulsion is and the smaller the particles of emulsion. Additionally, certain types of accelerants such as reverse emulsifier may also induce a phase change of emulsion. The main functions of an auxiliary agent are to cause an unstable emulsion and to speed up aggregation and coalescence among emulsion particles. Similarly, certain types of auxiliary agents may also cause a phase change of emulsion.

Speed of Stirring: A high speed homogenizer may help to make a dispersed and stable emulsion. The obtained particles of emulsion are small and uniform, resulting in small diameters and narrow distribution of resin particles. While a low speed stirring may lead to large diameters and a wide distribution of resin particles. However, if the stirring speed is too high, it may cause the probability of coalescence emulsion particles to increase, thereby increasing the size of the particles. On the other hand, the high speed of operation consumes more energy. In one embodiment, the stirring speed is in the range of about 800-3000 rpm.

The process for controlling shapes, diameters, and diameter distribution of toner particles to be produced according to the present invention has the advantages compared to conventional aggregation-coalescence method methods. The conventional aggregation-coalescence methods use an anticoagulant and an accelerant to control a primary aggregation and coalescence for high molecular weight colloidal particles. A high degree of aggregation and coalescence produces larger particles. Otherwise, smaller particles are produced. Therefore, sizes of toner particles are adjusted by the use of the anticoagulant and the accelerant. However, according to the present invention, in addition to an anticoagulant, the concentration of the phase change stabilizer in the organic phase, the solubility of the organic phase in water, the solid content of the organic phase, and/or a stirring speed for aggregation and coalescence of microparticles can also be utilized to modify the stability of the phase change of the resin emulsion, the uniformity of the resin emulsion, the aggregation and coalescence of resin particles, and the solidification rate of the resin particles so as to control shapes, diameters, and diameter distribution of toner particles. For primary colloidal particles leads having a uniform diameter, it leads to a narrow distribution of diameters of particles of a final production of a toner composition. Otherwise, it leads to a wide distribution of diameters of particles of a final production of a toner composition. For resin microparticles having a fast solidification rate, the resultant resin particles have irregular shapes and small sizes. In contrast, the resultant resin particles have sphere-like shapes and large sizes. Shapes, diameters, and diameter distribution of toner particles can be effectively controlled according to the invented process. In one embodiment, the toner particles are obtained, which have an average diameter by volume (Dv) in the range of about 3-10 μm, an average diameter by particle number (Dp) in the range of about 2-8 μm, and a diameter distribution (Dv/Dp) less than about 1.3.

These and other aspects of the present invention are more specifically described below.

EXAMPLES OF THE INVENTION

Without intent to limit the scope of the invention, further exemplary methods and their related results according to the embodiments of the present invention are given below. Note again that titles or subtitles may be used in the examples for convenience of a reader, which in no way should limit the scope of the invention.

Example 1

A vessel of 1,000 ml was provided for forming an organic phase therein. 237.6 g styrene-acrylate copolymers (Mw=98,000, Mw/Mn=20, Sekisui Chemical (Taiwan) Co., Ltd., Taipei, Taiwan), 330 g ethyl acetate (solubility 79 g/kg in water), 13.5 g Montan wax (Clariant Chemicals (Taiwan) Co. Ltd, Taipei, Taiwan), and 2.7 g zinc stearate (Chant Oil, CO. Ltd.) were added into the 1,000 ml vessel to form a first mixture. The first mixture was stirred at a stirring speed of about 500 rpm while being heated to about 100-110° C. for 10-30 min until all Montan wax and zinc stearate were completely dissolved. Then, the stirring speed was changed to about 1,000 rpm while the temperature of the first mixture was cooled down to precipitate Montan wax and zinc stearate. The stirring of the mixture was continued for evenly throughout mixing. Then, the mixture was transferred into a dispersing and shaking flask. 13.5 g Pigment Blue-15:3 (Janie Color Works, Ltd.) and 2.7 g E84 (Orient Chemical Industries, Ltd., Osaka, Japan) and 300 g glass beads of about 1 mm diameter were added into the first mixture in the flask. The flask was sealed and shaken for about 2 days. Then, residue materials were removed and the glass beads were filtered out. A blue organic resin solution (organic phase) with a solid content of about 45% (by weight) was obtained.

A vessel of 500 ml was provided for forming an aqueous phase therein. 30 g of polyvinyl alcohol, PVA BC20 (Chang Chun Petrochemical, Co. Ltd.), 2 g Tween 20 (Showa, Japan) and 168 g deionic water were added into the 500 ml vessel to form a second mixture. The second mixture was heated to about 60° C. and was been stirring until all PVA was dissolved and dispersed evenly and throughout. Then the second mixture was cooled down to the room temperature to obtain an aqueous phase (water solution). In the aqueous phase, the concentration of PVA is about 15% (by weight) and Tween 20 is about 1% by weight.

Then, 60 g of the organic resin solution (organic phase) was added in a stirring tank. The organic resin solution was stirred at about 1,200 rpm at the room temperature, meanwhile the water solution (aqueous phase) was added into the tank, and both the organic resin solution and the water solution were then mixed thoroughly by the stirring. The resin in the organic resin solution is gradually separated out while the water solution was been adding. The water solution was continuously added into the organic resin solution until a uniform and thoroughly dispersed colloidal solution was formed. The stirring continued for about 10 min and a proper amount of distilled water was added to speed up colloidal solidification of resin particles. Then a dispersion solution of the resin particles was obtained.

After filtering the resin particles from the dispersion solution of the resin particles, the resin particles were washed a few times with deionic water. Then, the resin particles were dried in a vacuum oven to obtain the dried resin particles. 100 parts of the dried resin particles were mixed with 2 parts of additional additive R972 (Degussa, Germany) to produce a toner composition.

Example 2

In this example, the processes of preparing an organic phase and an aqueous phase and producing a toner composition were the same as those disclosed in Example 1. Main differences between Examples 1 and 2 were that the resin was bisphenol-A fumarate polyester resin (Reichhold) and the organic solvent was MEK/THF mixture solvent in Example 2. Also, no zinc stearate was added into the organic phase, and the temperature for forming the the organic phase was changed from 100-110° C. to 70-75° C. in Example 2. The detail formulas of the organic and aqueous phases were shown in Tables 1 and 2.

TABLE 1

Composition of an Organic Phase Listed by Examples (SAC: styrene-acrylate copolymers, MW: Montan wax, ST: Stearate, and ZST: Zinc stearate.)

| | Resin Solution | | | Toner Composition | | | | |
|---|---|---|---|---|---|---|---|---|
| Example Number | Solvent Solubility (g/Kg-water) | Solid Content wt % | Viscosity Ratio | Resin wt % | Colorant wt % | CCA wt % | Phase Change Stabilizer wt % | |
| | Examples -- Composition of an Organic Phase | | | | | | | |
| 1 | EAc(79) | — | — | SAC | PB15:3 | E84 | MW | ZST |
| | — | 45 | 0.05 | 88 | 5 | 1 | 5 | 1 |
| 2 | MEK(290) | — | — | Polyesters | PR-269 | E84 | MW | — |
| | THF(∞) | 45 | 0.24 | 89 | 5 | 1 | 5 | 0 |
| 3 | MEK(290) | — | — | SAC | PB15:3 | E84 | MW | — |
| | — | 50 | 10.94 | 84 | 5 | 1 | 10 | 0 |
| 4 | EAc(79) | — | — | Polyesters | PB15:3 | E84 | MW | — |
| | MEK(290) | 45 | 0.25 | 89 | 5 | 1 | 5 | 0 |
| 5 | EAc(79) | — | — | Polyesters | PR-269 | E84 | MW | — |
| | CYC(24) | 45 | 0.25 | 89 | 5 | 1 | 5 | 0 |
| 6 | EAc(79) | — | — | SAC | PB15:3 | E84 | MW | ZST |
| | — | 35 | 0.19 | 88 | 5 | 1 | 5 | 1 |
| 7 | EAc(79) | — | — | SAC | PB15:3 | E84 | MW | — |
| | — | 35 | 0.18 | 89 | 5 | 1 | 5 | 0 |
| 8 | EAc(79) | — | — | Polyesters | PB15:3 | E84 | MW | — |
| | MEK(290) | 45 | 1.05 | 84 | 5 | 1 | 10 | 0 |
| 9 | MEK(290) | — | — | Polyesters | PR-269 | E84 | MW | ZST |
| | THF(∞) | 45 | 0.26 | 88 | 5 | 1 | 5 | 1 |
| 10 | EAc(79) | — | — | Polyesters | PY-151 | E84 | MW | ZST |
| | MEK(290) | 45 | 12.54 | 78 | 10 | 1 | 10 | 1 |
| 11 | PMA(198) | — | — | Polyesters | 330R | E84 | MW | ZST |
| | EAc(79) | 38 | 0.27 | 86 | 6 | 2 | 5 | 1 |
| 12 | MEK(290) | — | — | Polyesters | PR-122 | E108 | ST | — |
| | — | 30 | 3.53 | 84 | 5 | 1 | 10 | 0 |
| | Comparative Examples -- Composition of an Organic Phase | | | | | | | |
| 1 | EAc(79) | — | 0.55 | SAC | PB15:3 | E84 | MW | ZST |
| | — | 45 | — | 88 | 5 | 1 | 5 | 1 |
| 2 | MEK(290) | — | 2.81 | SAC[1] | PB15:3 | E84 | MW | — |
| | — | 50 | — | 84 | 5 | 1 | 10 | 0 |
| 3 | MEK(290) | — | 4.71 | Polyesters | PR-122 | E108 | ST | — |
| | — | 30 | — | 84 | 5 | 1 | 10 | 0 |
| 4 | Eac(79) | — | 1.16 | Polyesters | PB15:3 | E84 | MW | — |
| | MEK(290) | 45 | — | 89 | 5 | 1 | 5 | 0 |
| 5 | Eac(79) | — | 0.29 | SAC | PB15:3 | E84 | MW | ZST |
| | — | 45 | — | 88 | 5 | 1 | 5 | 1 |
| 6 | Eac(79) | — | 0.18 | Polyesters | PR-122 | E84 | — | — |
| | CYC(24) | 50 | — | 94 | 5 | 1 | 0 | 0 |
| 7 | Eac(79) | — | 0.14 | SAC | PB15:3 | E84 | — | — |
| | — | 35.0 | — | 94 | 5 | 1 | 0 | 0 |
| 8 | MEK(290) | — | 34.08 | SAC | PB15:3 | E84 | MW | — |
| | — | 50 | — | 84 | 5 | 1 | 10 | 0 |

TABLE 2

Composition of a Aqueous Phase Listed by Examples

| | Examples - Composition of an Aqueous Phase | | | |
|---|---|---|---|---|
| Example Number | Anti-coagulant (wt %) | Accelerant (wt %) | Auxiliary Agents (wt %) | Aggregation Stirring Speed (rpm) |
| 1 | PVA | Tween 20 | — | |
| | 15 | 1 | 0 | 1200 |
| 2 | PVA | Tween 20 | — | |
| | 10 | 1 | 0 | |
| 3 | PVA | Tween 20 | — | 1200 |
| | 7.5 | 1 | 0 | |
| 4 | PVA | Tween 20 | — | |
| | 10 | 1 | 0 | 1200 |
| 5 | PVA | Tween 20 | — | |
| | 10 | 1 | 0 | 1200 |

TABLE 2-continued

Composition of a Aqueous Phase Listed by Examples

| | | | | |
|---|---|---|---|---|
| 6 | PVA | Tween 20 | — | |
| | 10 | 1 | 0 | 1200 |
| 7 | PVA | Tween 20 | — | |
| | 10 | 1 | 0 | 1200 |
| 8 | PVA | Tween 20 | — | |
| | 10 | 1 | 0 | 1200 |
| 9 | PVA | Tween 20 | — | |
| | 10 | 1 | 0 | 1200 |
| 10 | PVA | Tween 20 | — | |
| | 7.5 | 1 | 0 | 1200 |
| 11 | PVA | Tween 20 | — | |
| | 10 | 1 | 0 | 1200 |

TABLE 2-continued

| Composition of a Aqueous Phase Listed by Examples | | | | |
|---|---|---|---|---|
| 12 | PVA<br>2 | Tween 20<br>1 | NaCl<br>0.1 | 1200 |

| Example Number | Comparative Examples -- Composition of an Aqueous Phase | | | |
|---|---|---|---|---|
| | Anti-coagulant (wt %) | Accelerant (wt %) | Auxiliary Agents (wt %) | Aggregation Stirring Speed (rmp)) |
| 1 | PVA<br>9 | Tween 20<br>1 | —<br>0 | —<br>1200 |
| 2 | PVA<br>7.5 | Tween 20<br>1 | —<br>0 | —<br>1200 |
| 3 | HEC<br>2 | Tween 20<br>1 | —<br>0 | —<br>1200 |
| 4 | PVA<br>7.5 | Tween 20<br>1 | —<br>0 | —<br>1200 |
| 5 | PVA<br>10 | Tween 20<br>1 | —<br>0 | —<br>600 |
| 6 | CMC-Na<br>1 | Tween 20<br>1 | —<br>0 | —<br>1200 |
| 7 | PVA<br>10 | Tween 20<br>1 | —<br>0 | —<br>1200 |
| 8 | PVA<br>3 | Tween 20<br>1 | —<br>0 | —<br>1200 |

Example 3

In this example, the processes of preparing an organic phase and an aqueous phase and producing a toner composition were the same as those disclosed in Example 2. Main differences between Examples 2 and 3 were: in Example 3, no CCA was added; the pigment of PR-269 was replaced by PB-15:3; MEK was used as the organic solvent; and the resin was used a mixture of high and low molecules of styrene-acrylate copolymers (the low molecule resin provided by SEKISUI, Mw=10,200, Mw/Mn=2.5; the high molecule resin provided by MITSUI, Mw=276,000, Mw/Mn=81.3). The other differences such as compositions of the organic and aqueous phases were shown in Tables 1 and 2.

Example 4

In Example 4, the processes of preparing an organic phase and an aqueous phase and producing a toner composition were the same as those disclosed in Example 2. Main differences between Examples 2 and 4 were: in Example 4, an MEK/EAc mixture solvent was employed as the organic solvent; the pigment of PR-269 was replaced by PB15:3. The other differences such as compositions of the organic and aqueous phases were shown in Tables 1 and 2.

Example 5

In this example, the processes of preparing an organic phase and an aqueous phase and producing a toner composition were the same as those disclosed in Example 2. Main differences between Examples 2 and 5 were: in Example 5, the organic solvent was changed to an EAc/CYC mixture solvent. The other differences such as compositions of the organic and aqueous phases were shown in Tables 1 and 2.

Example 6

In this example, the processes of preparing an organic phase and an aqueous phase and producing a toner composition were the same as those disclosed in Example 1. Main differences between Examples 1 and 6 were: in Example 6, the solid content of the organic phase was changed from 45% by weight to 35% by weight. The details of compositions of the organic and aqueous phases were listed in Tables 1 and 2.

Example 7

In Example 7, the processes of preparing an organic phase and an aqueous phase and producing a toner composition were the same as those disclosed in Example 6. Main differences between Examples 6 and 7 were: in Example 7, no zinc stearate was added; and the temperature for preparing the organic phase was changed from 100-110° C. to 70-75° C. The details of compositions of the organic and aqueous phases were listed in Tables 1 and 2.

Example 8

In this example, the processes of preparing an organic phase and an aqueous phase and producing a toner composition were the same as those disclosed in Example 4. Main differences between Examples 4 and 8 were: in Example 8, Montan wax was increased from 5% by weight to 10% by weight. Other compositions of the organic and aqueous phases were listed in Tables 1 and 2.

Example 9

In Example 9, the processes of preparing an organic phase and an aqueous phase and producing a toner composition were the same as those disclosed in Example 2. Main differences between Examples 2 and 9 were: in Example 9, micro-particles of zinc stearate with an average diameter of about 0.1-1 μm were added into the organic phase; the temperature for preparing the organic phase was reduced from 100-110° C. to 70-75° C. The details of compositions of the organic and aqueous phases were listed in Tables 1 and 2.

Example 10

In this example, the processes of preparing an organic phase and an aqueous phase and producing a toner composition were the same as those disclosed in Example 8. Main differences between Examples 8 and 10 were: in Example 10, micro-particles of zinc stearate with an average diameter of 0.1-1 μm were added into the organic phase; the temperature for preparing the organic phase was reduced from 100-110° C. to 70-75° C.; and the pigment of PB15:3 was replaced by PY-151. The details of compositions of the organic and aqueous phases were listed in Tables 1 and 2.

Example 11

In Example 11, the processes of preparing an organic phase and an aqueous phase and producing a toner composition were the same as those disclosed in Example 9. Main differences between Examples 9 and 11 were: in Example 11, the pigment of PR-269 was replaced to 330R (Cabot); and the solvent was changed to PMA/EAc mixture. The other differences compositions of the organic and aqueous phases were listed in Tables 1 and 2.

Example 12

In Example 12, the processes of preparing an organic phase and an aqueous phase and producing a toner composition were the same as those disclosed in Example 3. Main differences between Examples 3 and 12 were: in Example 12, Montan wax was replaced by stearate; the pigment of PB-15:3 was replaced by PR-122; and a copolymer of K5011 (provided by Eternal, Mn=26,000, Mw/Mn=2) and K5010 (Eternal, Mn=10,000, Mw/Mn=2) was used as the resin in the organic phase. The details of compositions of the organic and aqueous phases were listed in Tables 1 and 2.

Comparative Example 1

In Comparative Example (CE) 1, the processes of preparing an organic phase and an aqueous phase and producing a toner composition were the same as those disclosed in Example 1. Main differences between Example 1 and CE 1 were: in CE 1, the concentration of PVA in the aqueous phase was decreased from 15% by weight to 9% by weight. The details of compositions of the organic and aqueous phases were listed in Tables 1 and 2.

Comparative Example 2

In CE 2, the processes of preparing an organic phase and an aqueous phase and producing a toner composition were the same as those disclosed in Example 3. Main difference between Example 3 and CE 2 was: in CE 2, a low molecule styrene-acrylate copolymers (SEKISUI, Mw=10,200, Mw/Mn/2.5) was used as the resin in the organic phase. The details of compositions of the organic and aqueous phases were listed in Tables 1 and 2.

Comparative Example 3

In CE 3, the processes of preparing an organic phase and an aqueous phase and producing a toner composition were the same as those disclosed in Example 12. Main difference between Example 12 and CE 3 was: in CE 3, no any auxiliary agent was added into the aqueous phase. The details of compositions of the organic and aqueous phases were listed in Tables 1 and 2.

Comparative Example 4

In CE 4, the processes of preparing an organic phase and an aqueous phase and producing a toner composition were the same as those disclosed in Example 4. Main difference between Example 4 and CE 4 was: in CE 4, the resin in the organic phase was changed to a low molecule polyester (provided by Reichhold, Mw=13,600, Mw/Mn=3). The details of compositions of the organic and aqueous phases were listed in Tables 1 and 2.

Comparative Example 5

In CE 5, the processes of preparing an organic phase and an aqueous phase and producing a toner composition were the same as those disclosed in Example 1. Main difference between Example 1 and CE 5 was: in CE 5, the stirring speed for aggregation and coalescence of particles was changed from 1,200 rpm to 600 rpm. The details of compositions of the organic and aqueous phases were listed in Tables 1 and 2.

Comparative Example 6

In CE 6, the processes of preparing an organic phase and an aqueous phase and producing a toner composition were the same as those disclosed in Example 1. Main differences between Example 1 and CE 6 were: in CE 6, a low molecule polyester (provided by Libond, Mw=3,000) was as the resin in the organic phase; and no phase change stabilizer was added into the organic phase. The details of compositions of the organic and aqueous phases were listed in Tables 1 and 2.

Comparative Example 7

In CE 7, the processes of preparing an organic phase and an aqueous phase and producing a toner composition were the same as those disclosed in Example 6. Main differences between Example 6 and CE 7 were: in CE 7, no phase change stabilizer was added into the organic phase. The details of compositions of the organic and aqueous phases were listed in Tables 1 and 2.

Comparative Example 8

In CE 8, the processes of preparing an organic phase and an aqueous phase and producing a toner composition were the same as those disclosed in Example 3. Main differences between Example 3 and CE 8 were: in CE 8, the concentration of PVA in the aqueous phase was decreased from 7.5% by weight to 3% by weight. The details of compositions of the organic and aqueous phases were listed in Tables 1 and 2.

Analysis on Diameters of the Phase Change Stabilizer

Diameters and diameter distribution of the phase change stabilizer, used in the above examples of the present invention, were detected by a dynamic diameter analyzer, Zetasizer nano ZS (Malvern Instruments, Ltd., Worcestershire, England). The detection was performed as follows: a drop of a resin solution containing the phase change stabilizer was taken; the drop of the resin solution was diluted with a solvent of 50 ml and stirred with an ultrasound dispersing probe for 1 min so as to obtain a testing sample. Then, a proper amount of the testing sample was loaded into a sample cell of the analyzer. The diameter and the diameter distribution of the phase change stabilizer were detected by a dynamic laser scan. For example, in Example 7, the average diameter of the phase change stabilizer was detected to be in the range of about 0.375-0.493 μm.

Analysis on the Viscosity Ration of the Organic Phase and the Aqueous Phase

The viscosity ratio of the organic phase and the aqueous phase, used in the above examples of the present invention, were detected by a viscometer, Visco Basic plus (Fungilab S.A.) The detection was performed as follows: a proper amount of the organic phase or the aqueous phase was taken and put into a 600 ml beaker. Based on the viscosity of the testing solution (the organic phase or the aqueous phase), a suitable spindle and corresponding rotating speed were selected. Then, adjusting the rotating speed of the spindle, when the torque of the spindle is in the range of about 60-80%, a value of viscosity was read.

Analysis on Diameters of the Toner Particles

Diameters and diameter distribution of toner particles, produced in the above examples of the present invention, were detected by a diameter analyzer, Multisizer™ 3 COULTER COUNTER (Beckman Counter). An aperture tube with a diameter of 100 μm, having a detection range of about 2-60

μm was selected. The diameter detection was performed as follows: a background calibration was performed with a standard solution filled in a cup with a 60-70% full of the cup. Then, an analysis on diameter began when a diluted test solution was added into the standard solution to reach a concentration of about 10% in the standard solution. The diameter detection of about 30,000 toner particles took about 5-20 sec, depending on the concentration of the test solution. The analyzer then analyzed the detected results and displayed same in a cumulated graph, in terms of a volume or a number of an average diameter of the detected toner particles. The detected results were listed in Table 3.

TABLE 3

Comparison for Diameters and Diameter Distribution of Toner Particles (SAC: styrene-acrylate copolymers and CE: Comparative Examples.)

| Example Number | Resin | Shape | Diameter by Volume $D_V$(μm) | Diameter by Particle Number $D_P$(μm) | Diameter Distribution $D_V/D_P$ | $D_V < 4$ μm $D_P < 4$ μm (%) | $D_V > 15$ μm $D_P > 15$ μm (%) |
|---|---|---|---|---|---|---|---|
| 1 | SAC | Sphere | 7.0 | 5.7 | 1.23 | 0.98 | 2.30 |
| | | Uniform | | | | 15.60 | 0.05 |
| 2 | Polyesters | Sphere | 9.1 | 7.5 | 1.21 | 0.47 | 3.90 |
| | | Uniform | | | | 10.6 | 0.42 |
| 3 | SAC | Sphere | 10.2 | 8.5 | 1.20 | 0.22 | 1.71 |
| | | Uniform | | | | 5.98 | 0.28 |
| 4 | Polyesters | Sphere | 10.0 | 8.3 | 1.20 | 0.19 | 3.20 |
| | | Uniform | | | | 5.64 | 0.46 |
| 5 | Polyesters | Sphere-like | 7.2 | 5.4 | 1.30 | 2.95 | 9.06 |
| | | Uniform | | | | 19.20 | 0.29 |
| 6 | SAC | Sphere | 6.9 | 5.7 | 1.20 | 1.74 | 0.12 |
| | | Uniform | | | | 12.90 | 0.01 |
| 7 | SAC | Sphere-like | 10.2 | 8.2 | 1.24 | 0.34 | 2.48 |
| | | Uniform | | | | 9.48 | 0.41 |
| 8 | Polyesters | Sphere | 6.7 | 5.5 | 1.22 | 2.46 | 2.19 |
| | | Uniform | | | | 12.50 | 0.05 |
| 9 | Polyesters | Sphere | 7.2 | 6.0 | 1.2 | 1.72 | 3.37 |
| | | Uniform | | | | 15.70 | 0.11 |
| 10 | Polyesters | Sphere | 7.3 | 6.5 | 1.11 | 0.46 | 1.52 |
| | | Uniform | | | | 4.64 | 0.07 |
| 11 | Polyesters | Sphere | 7.9 | 7.0 | 1.13 | 0.21 | 17.40 |
| | | Uniform | | | | 4.10 | 0.93 |
| 12 | Polyesters | Sphere | 13.3 | 10.2 | 1.30 | 0.17 | 29.30 |
| | | Uniform | | | | 8.69 | 7.20 |
| CE 1 | SAC | Sphere-like | 15.9 | 6.3 | 2.52 | 1.32 | 56.60 |
| | | Uniform | | | | 48.9 | 7.29 |
| CE 2 | SAC | Sphere-like | 9.0 | 6.1 | 1.48 | 1.77 | 3.24 |
| | | Uniform | | | | 16.90 | 0.03 |
| CE 3 | Polyesters | Sphere not | 20.6 | 5.6 | 3.68 | 1.18 | 75.70 |
| | | Uniform | | | | 66.2 | 8.61 |
| CE 4 | Polyesters | Sphere | 12.0 | 7.8 | 1.54 | 0.78 | 7.36 |
| | | Uniform | | | | 27.80 | 1.11 |
| CE 5 | SAC | Sphere | 15.5 | 10.7 | 1.45 | 0.13 | 50.10 |
| | | Uniform | | | | 10.2 | 16.00 |
| CE 6 | Polyesters | Sphere | 8.6 | 7.4 | 1.16 | 0.46 | 0.20 |
| | | Uniform | | | | 7.87 | 0.01 |
| CE 7 | SAC | Sphere-like | 8.9 | 3.6 | 2.47 | 21.60 | 15.40 |
| | | Uniform | | | | 73.40 | 0.18 |
| CE 8 | SAC | phase separation and agglomeration | | | | | |

Observation on Shapes of the Toner Particles

The toner particles, produced in the above examples of the present invention, were observed under an optical microscope, PM-217T (OME TOP Systems Co., Ltd.). The observation was performed as follows: a drop of diluted toner solution was load and dispersed evenly onto a glass substrate. After the solution was dried, the substrate was placed onto the microscope. The shapes and appearances of the toner particles were observed by adjusting the magnification of the microscope. The images were saved through CCD into a computer.

Analysis on the Printing Quality

The printing quality of the toner particles, produced in the above examples of the present invention, was tested by a color laser printer, QMS-2350 (Konica-Minolta). At first, a standard printing patterns was produced by testing software; then, an amount of reflecting light was analyzed by a reflection densitometer, RD921 (Macbeth), whereby a color density on the printing pattern was obtained. At the meantime, it proceeded with observing whether the toner particles had caused some scratches, toner dusting, and hot-offset, etc. on the printer's components, such as developer roller, doctor blade, organic photoconductor, wipe blade, fuser roller, and so on. Additionally, after finishing print test, the toner cartridge was taken out for the tribocharging analysis, which was conducted by a charge-to-mass ratio (Q/m) test analyzer, Model 210HS (Trek, Inc., Medina, N.Y.). The testing results were listed in Table 4.

TABLE 4

Comparison for Printing Properties of Toner

| Example Number | Stick on Printer parts | Hot-Offset | Toner Dusting | Tribo-charge | Color Density |
|---|---|---|---|---|---|
| 1 | No | No | No | −11.2 | 1.42 |
| 2 | No | No | No | −8.6 | 1.20 |
| 3 | No | No | No | −9.3 | 1.31 |
| 6 | No | No | No | −10.8 | 1.38 |
| 10 | No | No | No | −9.8 | 1.00 |
| 11 | No | No | No | −7.4 | 1.48 |
| CE 1 | No | No | Yes | −1.2 | 0.50 |
| CE 2 | Yes | Yes | Yes | −4.5 | 0.73 |
| CE 4 | Yes | Yes | Yes | −3.5 | 0.61 |
| CE 5 | No | No | Yes | −2.6 | 0.52 |
| CE 6 | Yes | Yes | No | −6.8 | 0.49 |
| CE 7 | No | No | Yes | −4.2 | 0.66 |

Analysis on the Examples

Shapes, diameters, and diameter distribution of the toner particles, produced in the above examples, are shown in Tables 3 and 4.

Comparing the results of Example 1 and CE 1, as listed Table 3, when the concentration of anticoagulant in the aqueous phase reduces, meant the aqueous phase viscosity reduces, it will cause the high viscosity organic phase not easy to complete the phase change of emulsion, after as well as will change the droplet dispersible stability, thus will induce the final resin particle size to increase, also the diameter distribution will also broaden, as shown in Table 3. Large diameters of the toner particles would lead to reduce the tribocharging of toner particles, and therefore, cause toner dusting and insufficient color density in the printing. Furthermore, non-uniformity of the diameters of the toner particles would affect the flowability and uniformity of the tribocharging of the toner particles, thereby causing a reduction of the printing quality and an abnormal toner flow of the toner cartridge, as shown in Table 4. The similar reasons, it is obvious that, by comparisons of Examples 1 and 6, the solid content of organic phase low system, for example, in Example 6, because the viscosity of organic phase is low, relative the stability and the disperser efficiency of phase change of emulsion is better, therefore obtains the particle size and the distribution good resin particles, as shown in Table 3. When the anticoagulant concentration is too low inducing viscosity of the aqueous phase to be insufficient, will cause the high viscosity organic phase to be unable to complete the phase change of emulsion, then will cause the resin agglomeration and phase separation, as shown in CE 8. Therefore, the viscosity ratio of the organic phase to the aqueous phase has the remarkable influence to control the particle size and the distribution of resin particles, one of each implementation examples of viscosity ratio as shown in Table 1.

As shown in Examples 2 and 5, the solubility of the organic solvent played a very important role in production of a toner composition according to the present invention. A proper degree of the solubility of the organic solvent could be used to adjust the rate of solidification of the resin particles and the rate of extraction of the organic solvent, and reduce diameters of the toner particles and narrow the diameter distribution of the toner particles, as shown in Table 3.

Additionally, as shown in Example 3 and CE 2, or Example 4 and CE 2, the invented method could be utilized for resins with different molecular weights and other hybrids. By adding a high molecule weight resin into a low molecule weight resin, the thermal viscoelasticity and the mechanical strength of the resin were enhanced, which improved toner sticking on printer components and hot-offset printing of toner particles produced from a resin of a lower molecule weight, as shown in Table 4.

Comparing Examples 6 and 7 and CE 7, it was found that for an organic resin solution without a phase change stabilizer, for example, in CE 7, the stability of phase changes and the aggregation and coalescence of resin particles were poor, which resulted in more toner particles having small diameters and a wider diameter distribution of the toner particles. When the amount of Montan wax was added to the organic resin solution, for example, in Example 7, the stability of the phase change and the rate of the aggregation and coalescence of resin particles were improved significantly, which resulted in smaller diameters and narrower diameter distribution of the toner particles. If zinc stearate was further added to the organic resin solution, for example in Example 6, the diameters and diameter distribution of the toner particles were further improved, as shown in Table 3. The results in Examples 4 and 8 showed that increasing the concentration of Montan wax in the organic resin solution resulted in reducing the diameters of resin particles. Additionally, as CE 6 showed that for resins of small molecule weights, excellent diameters and diameter distribution of the resin particles were obtained without a phase change stabilizer in the organic resin solution. However, the toner particles produced from the low molecule weight resins would cause toner sticking on printer components and hot-offset, and so on, as shown in Table 4.

Comparing Example 1 and CE 5, it was shown that for the operation at a low rotating speed, due to a weakly mechanical dispersing force, a degree of aggregation and coalescence of the resin particles was increased, which resulted in larger diameters and wider diameter distribution of resin particles to be formed, as shown in Table 3.

From Example 12 and CE 3, it was found that for certain systems, if no auxiliary agent was added, the aggregation and coalescence of the resin particles would be not controllable. This led to the diameter by volume (Dv) and the diameter by particle number (Dp) of the toner particles having two extreme values. An auxiliary agent might play a role in speeding up the aggregation and coalescence of the resin particles. Accordingly, the process of the aggregation and coalescence of the resin particles would be finished before the system was out of control, thereby resulting in the desired diameter and diameter distribution of resin particles, as shown in Table 3.

The present invention, among other things, discloses a method of producing toner particles having shapes, diameters, and diameter distribution that are adjusted by controlling the stability of an organic phase with a high viscosity ratio during emulsion phase changes, the dispersive stability of resin particles, and the rate of solidification and solvent extraction of the resin particles. In addition, a phase change stabilizer and an anticoagulant are used to effectively control the shapes, diameters, and diameter distribution of the toner particles. The toner composition produced according to the invented method is suitable for electrostatic xerographic devices of different types and brands.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A method of producing a toner useable in an image forming apparatus, comprising the steps of:

a. forming an organic phase containing a resin, an organic solvent, a colorant, a charge control agent, and a phase change stabilizer, wherein the phase change stabilizer is in a gelation state or in a form of a microparticle having an average diameter of about 0.1-1 μm;

b. forming an aqueous phase containing water, an anticoagulant, an accelerant, and optionally an auxiliary agent;

c. mixing the aqueous phase and the organic phase to induce the phase change and to form an indirect emulsified solution having resin colloidal microparticles formed and stably dispersed therein, whereby the resin colloidal microparticles aggregate, coalesce and solidify out into resin particles in the solution, meanwhile the phase change stability and emulsion dispersibilty are improved by controlling the amount of the phase change stabilizer in the organic phase and the viscosity ratio of the organic phase to the aqueous phase; and d. curing the resin particles to obtain toner particles having shapes, diameters, and diameter distribution that are controllable.

2. The method of claim 1, wherein the mixing step comprises the steps of:

a. stirring the organic phase;

b. adding the aqueous phase into the stirred organic phase to form the solution; and c. stirring the solution evenly and thoroughly.

3. The method of claim 1, wherein the resin is insoluble in water.

4. The method of claim 3, wherein the resin comprises a polyamide, polyester, styrene-acrylate copolymer, polystyrene, acrylic resin, epoxy resin, copolyamide, polyolefin, polycarbonate, polyacrylamide, ethylene-vinyl acetate copolymer, polyvinyl acetate, polyvinyl butyral, or a combinations thereof.

5. The method of claim 1, wherein the charge control agent comprises quaternary ammonium salt, salicylic acid metal-complex, azo metal-complex, aromatic carboxylic metal-complex, or one or more derivatives of them.

6. The method of claim 1, wherein the phase change stabilizer comprises at least one of a releasing agent, an lubricant, and an amphiphilic material.

7. The method of claim 6, wherein the releasing agent comprises a paraffin, fatty alcohol, fatty acid, fatty acid salt, polyethylene (PE) wax, polypropylene (PP) wax, polyester wax, animal wax, plant wax, synthesized wax, or any combination thereof.

8. The method of claim 6, wherein the lubricant comprises a fatty acid salt, resin microparticles, inorganic microparticles, or any combination thereof.

9. The method of claim 6, wherein the amphiphilic material comprises a fatty alcohol, fatty acid, or any combination thereof.

10. The method of claim 1, wherein the step of forming the organic phase comprises the step of dispersing the phase change stabilizer into the organic phase.

11. The method of claim 10, wherein the step of dispersing the phase change stabilizer comprises the steps of:

a. dissolving the phase change stabilizer in the organic phase at a first temperature;

b. reducing the temperature of the organic phase from the first temperature or adding a nonsolvent into the organic phase to induce the separation of the phase change stabilizer from the organic phase to form a gelation state or microparticles having an average diameter of 0.1-1 μm; and c. stirring the organic phase to directly disperse the separated microparticles of the phase change stabilizer into the organic phase.

12. The method of claim 1, wherein the organic solvent comprises a methanol, ethanol, n-propanol, iso-propanol, n-butanol, iso-butanol, tert-butanol, ethyl acetate, methyl acetate, ethyl formate, propylene glycol monomethyl ether acetate, ethylene glycol monoethyl ether acetate, ethylene glycol monomethyl ether acetate, acetone, methyl ethenyl ketone, methyl isobutyl ketone, methyl isopropyl ketone, cyclohexanone, ethylene glycol monobutyl ether, propylene glycol monomethyl ether, ethylene glycol monoethyl ether, tetrahydrofuran, dichloromethane, dichloroethane, chloroform, or any combination thereof.

13. The method of claim 1, wherein the anticoagulant comprises a polyvinyl alcohol, polyvinylpyrrolidone, methyl cellulose, ethyl cellulose, carboxymethyl cellulose (CMC), CMC salt including CMC—Na, hydroxyethyl cellulose, hydroxypropyl cellulose, hydroxyethyl methyl cellulose, hydroxypropyl ethyl cellulose, polyacrylic acid salt, polyacrylic amide, gelatin, acacia gum, starch, polyoxypropylene-polyoxyethylene copolymer, or any combination thereof.

14. The method of claim 1, wherein the accelerant comprises an alkylsulfate, alkylsulfonate, alkylnaphthalene sulfonate, fatty acid salt, alkylphosphate, alkylaminoate, alkylpolyoxyethylene ether, alkylpolyphenol ethoxylate, alkylolamide, polyoxyethylene sorbitan fatty acid ester, sorbitan fatty acid ester, or any combination thereof.

15. The method of claim 1, wherein the auxiliary agent comprises one of a monovalent salt, divalent salt, trivalent salt, and inorganic acid or alkali, wherein the monovalent salt includes sodium chloride, the divalent salt includes sodium sulfate, the trivalent salt includes aluminum sulfate, and the inorganic acid or alkali includes sodium hydroxide or nitric acid.

16. The method of claim 1, wherein the shapes, diameters, and diameter distribution of the toner particles are controllable by adjusting at least one of:

a. a concentration of the phase change stabilizer in the organic phase;

b. a solubility of the organic phase in the aqueous phase;

c. a solid content of the organic phase;

d. a viscosity ratio of the organic phase to the aqueous phase; and e. a stirring speed for aggregation and coalescence.

17. The method of claim 16, wherein the diameters and the diameter distribution of the toner particles are reversely proportional to the concentration of the phase change stabilizer, preferably, the concentration of the phase change stabilizer being in the range of about 0.1-20 wt%.

18. The method of claim 16, wherein the solubility of the organic phase in water is preferably greater than 1 wt%.

19. The method of claim 16, wherein the diameters and the diameter distribution of the toner particles are proportional to the solid content of the organic phase, preferably, the solid content of the organic phase being in the range of about 30-80 wt%.

20. The method of claim 16, wherein the diameters and the diameter distribution of the toner particles are reversely proportional to the viscosity ratio of the organic phase to the aqueous phase, preferably, the viscosity ratio of the organic phase to the aqueous phase being in the range of about 0.05-20.

21. The method of claim 16, wherein the diameters and the diameter distribution of the toner particles are reversely proportional to the stirring speed, preferably, the stirring speed being in the range of about 800-3000 rpm.

22. The method of claim 1, wherein the curing step comprising the steps of:

a. filtering the resin particles;

b. washing the resin particles; and c. drying the resin particles.

23. A method of producing a toner, comprising the steps of:

a. forming an organic phase containing a resin, an organic solvent, a colorant, a charge control agent, and a phase change stabilizer, wherein the organic solvent is characterized in that the resin is soluble in the organic solvent and the organic solvent and water are at least partially miscible with each other;

b. forming an aqueous phase containing water, an anticoagulant, an accelerant, and optionally an auxiliary agent;

c. mixing the aqueous phase with the organic phase to form a solution having a resin colloid; and d. curing the resin colloid to obtain toner particles, wherein at least one of control parameters including a concentration of the phase change stabilizer in the organic phase, a solubility of the organic phase in the aqueous phase, a solid content of the organic phase, a viscosity ratio of the organic phase to the aqueous phase, and a stirring speed for the mixing step is adjusted during at least one of the steps (a)-(d) to produce toner particles with at least one of desired shapes, desired diameters, and a desired diameter distribution.

24. The method of claim 23, where the mixing step is performed by stirring at a stirring speed that is uniform or variable.

25. A toner produced according to the method of claim 23.

* * * * *